US010648713B2

(12) United States Patent
Alwin et al.

(10) Patent No.: US 10,648,713 B2
(45) Date of Patent: May 12, 2020

(54) INDUSTRIAL HEAT TRANSFER UNIT

(71) Applicant: Titan, LLC, Plymouth, MN (US)

(72) Inventors: Hans Alwin, St. Michael, MN (US); Stanley Miskiw, Plymouth, MN (US)

(73) Assignee: Titan, LLC, Plymouth, MN (US)

( * ) Notice: Subject to any disclaimer, the term of this patent is extended or adjusted under 35 U.S.C. 154(b) by 25 days.

(21) Appl. No.: 15/891,437

(22) Filed: Feb. 8, 2018

(65) Prior Publication Data

US 2018/0224170 A1 Aug. 9, 2018

Related U.S. Application Data

(60) Provisional application No. 62/456,159, filed on Feb. 8, 2017.

(51) Int. Cl.

| | |
|---|---|
| ***F25B 29/00*** | (2006.01) |
| ***F25B 31/02*** | (2006.01) |
| ***F25B 30/02*** | (2006.01) |

(52) U.S. Cl.

CPC ..... *F25B 29/003* (2013.01); *F25B 30/02* (2013.01); *F25B 31/026* (2013.01); *F25B 2313/002* (2013.01)

(58) Field of Classification Search

CPC ..... F25B 1/047; F25B 1/005; F25B 25/005; F25B 2400/071

USPC ..... 165/62

See application file for complete search history.

(56) References Cited

U.S. PATENT DOCUMENTS

| | | | | |
|---|---|---|---|---|
| 2,062,054 A | | 11/1936 | Gale | |
| 2,200,215 A | | 5/1940 | Lewis | |
| 2,251,960 A | * | 8/1941 | Smith | F24F 1/022 312/334.18 |
| 2,274,774 A | | 3/1942 | Chambers | |

(Continued)

FOREIGN PATENT DOCUMENTS

| | | | |
|---|---|---|---|
| CN | 208075365 U | * | 11/2018 |
| JP | 2002115920 A | | 4/2002 |

(Continued)

OTHER PUBLICATIONS

PCT/US2011/028351, Written Opinion and International Search Report dated Nov. 18, 2011, 7 pages.

*Primary Examiner* — Jon T. Schermerhorn, Jr.
(74) *Attorney, Agent, or Firm* — Dicke, Billig & Czaja, PLLC

(57) ABSTRACT

An industrial heat transfer unit including a compressor, a condenser heat exchanger, an expansion valve structure, and an evaporator heat exchanger. The compressor outlet is fluidly connected to the condenser heat exchanger inlet; the condenser heat exchanger outlet is fluidly connected to the expansion valve inlet; the expansion valve outlet is fluidly connected to the evaporator heat exchanger inlet; and the evaporator heat exchanger outlet is fluidly connected to the compressor inlet. The condenser heat exchanger is retained vertically above the compressor to provide enhanced operational efficiency. In some embodiments, service regions of the compressor and heat exchangers face a housing window. Process lines of the heat exchanger(s) can be high pressure stainless steel tubes. The compressor can be a scroll compressor and can include a variable frequency drive controlling delivery of power to a motor.

13 Claims, 5 Drawing Sheets

(56) References Cited

U.S. PATENT DOCUMENTS 2,333,729 A 11/1943 Miller et al.
2,493,488 A 1/1950 Jordan et al.
2,857,747 A * 10/1958 MacCracken ..... F24F 3/0442 165/48.1
3,403,525 A 10/1968 Sterling et al.
3,926,008 A 12/1975 Webber
4,011,732 A * 3/1977 Doherty ..... F16L 39/005 62/50.7
4,055,299 A 10/1977 Norberg et al.
4,099,338 A 7/1978 Mullin et al.
4,173,125 A 11/1979 Bradshaw
4,191,029 A * 3/1980 Dunne ..... F25B 39/04 312/138.1
4,205,456 A 6/1980 Ayers et al.
4,242,882 A 1/1981 Abraham
4,291,757 A 9/1981 Redden
4,308,106 A 12/1981 Mannfeld
4,314,601 A 2/1982 Giuffre
4,321,328 A 3/1982 Hoge
4,337,584 A 7/1982 Johnson
4,350,571 A 9/1982 Erickson
4,390,396 A 6/1983 Koblenzer
4,454,720 A 6/1984 Leibowitz
4,545,211 A * 10/1985 Gaus ..... B60N 3/104 296/37.8
4,617,803 A 10/1986 Rossi
4,644,666 A 2/1987 Eberle et al.
4,711,294 A 12/1987 Jacobs et al.
5,031,409 A * 7/1991 Johnson ..... F25C 1/12 62/352
5,181,395 A * 1/1993 Carpenter ..... F25B 39/04 165/110
5,653,042 A 8/1997 Besnard
5,746,062 A 5/1998 Beaverson et al.
6,094,925 A 8/2000 Arshansky et al.
6,131,398 A 10/2000 Versteijnen
6,321,460 B1 11/2001 Jin
6,499,308 B2 12/2002 Inoue et al.
6,601,397 B2 8/2003 Pham et al.
6,751,972 B1 6/2004 Jungwirth
7,310,959 B2 12/2007 Braun et al.
7,601,858 B2 10/2009 Cantrell et al.
8,461,079 B1 * 6/2013 Fabry ..... A01N 59/26 504/101
9,677,796 B2 * 6/2017 Schaeffer ..... F25B 41/003
2002/0033024 A1 3/2002 Hebert
2002/0088577 A1 7/2002 Watson et al.
2004/0139760 A1 * 7/2004 Manole ..... F25B 1/005 62/298
2005/0244277 A1 * 11/2005 Hurst, Jr. ..... F04B 49/065 417/216
2007/0056312 A1 3/2007 Kobayashi
2008/0209759 A1 9/2008 Shivers
2008/0222913 A1 9/2008 Ronning et al.
2008/0307813 A1 12/2008 Lifson et al.
2010/0018228 A1 1/2010 Flammang et al.
2011/0096503 A1 4/2011 Avery et al.
2011/0239666 A1 * 10/2011 Allen ..... F25B 29/003 62/79
2012/0111039 A1 5/2012 Allen et al.
2015/0033771 A1 * 2/2015 Meade ..... F25B 1/005 62/79
2016/0348988 A1 * 12/2016 Dowell, Jr. ..... F28F 9/0246

FOREIGN PATENT DOCUMENTS

JP 2005345003 A 12/2005
JP 2007231866 A 9/2009
JP 2010025412 A 2/2010

* cited by examiner

INDUSTRIAL HEAT TRANSFER UNIT

CROSS-REFERENCE TO RELATED APPLICATIONS

This Non-Provisional patent application claims the benefit of the filing date of U.S. Provisional Patent Application Ser. No. 62/456,159, filed Feb. 8, 2017, the entire teachings of which are incorporated herein by reference.

BACKGROUND

The present disclosure relates to heat transfer systems and methods in industrial settings. More particularly, it relates to industrial heat transfer units for providing simultaneous heating and cooling.

In industrial processes, process fluids (e.g., refrigerant) are usually required for adding heat energy in some sub-processes and absorbing heat energy in other sub-processes. Warming the process fluid to that it can supply heat energy in sub-processes typically requires natural gas or other independent heat source. Similarly, cooling the process fluid so that it can absorb heat energy in sub-processes typically requires some type of refrigeration cycle.

Some heat transfer systems aim to use some of the heat from one process fluid to another in an industrial process without independent heat energy sources or sinks, but such systems use a central energy storage mechanism. One such energy storage mechanism is an energy field. In a typical heat pump application (such as a geothermal heating/cooling system) the construction of the energy field can exceed 50% of the total project cost. In addition, energy fields require a significant amount of physical space that in many potential applications is simply not available. Furthermore, transferring energy into and out of the centralized storage system itself requires energy reducing the overall system efficiency.

More recently, heat transfer systems or modules have been devised to permit the transfer of heat energy from one process fluid to another in an industrial process without the need for an energy field or centralized energy storage. For example, U.S. Publication No. 2011/0239666 (Allen et al.), the entirety of which is hereby incorporated by reference herein, describes heat transfer modules well-suited for industrial applications that draw heat from one process fluid into circulating refrigerant in an evaporator heat exchanger and supply that heat to a different process fluid in a condenser heat exchanger.

The heat transfer modules of Allen et al. are highly promising. Any improvements to these and similar heat transfer systems will be well-received.

SUMMARY

The inventors of the present disclosure have recognized that a need exists for industrial heat transfer units or systems that overcome one or more of the above-mentioned problems.

Some aspects of the present disclosure are directed to an industrial heat transfer unit including a compressor, a condenser heat exchanger, an expansion valve structure, and an evaporator heat exchanger. The compressor defines a refrigerant inlet and outlet. The condenser heat exchanger defines a refrigerant inlet and outlet, with the compressor refrigerant outlet being fluidly connected to the condenser heat exchanger refrigerant inlet. The expansion valve structure defines a refrigerant inlet and outlet, with the condenser heat exchanger refrigerant outlet being fluidly connected to the expansion valve refrigerant inlet. The evaporator heat exchanger defines a refrigerant inlet and outlet. The expansion valve refrigerant outlet is fluidly connected to the evaporator heat exchanger refrigerant inlet, and the evaporator heat exchanger refrigerant outlet is fluidly connected to the compressor refrigerant inlet. Finally, relative to an upright orientation of the industrial heat transfer unit, the condenser heat exchanger is retained vertically above the compressor. With this construction, operational efficiency is enhanced as compared to conventional heat transfer module designs. In some embodiments, the evaporator heat exchanger is horizontally aligned with the compressor. In other embodiments, the compressor and heat exchangers are maintained within a housing defining a window at one side thereof, with at least one, optionally all, of the compressor and heat exchangers arranged within the housing such that a corresponding service region faces the window. In other embodiments, fluid lines (e.g., refrigerant lines) of one or both of the heat exchangers are high pressure stainless steel tubes. In yet other embodiments, the compressor is a scroll compressor. In related embodiments, the compressor includes a motor and a variable frequency drive controlling delivery of power to the motor.

DETAILED DESCRIPTION

Figure 1:
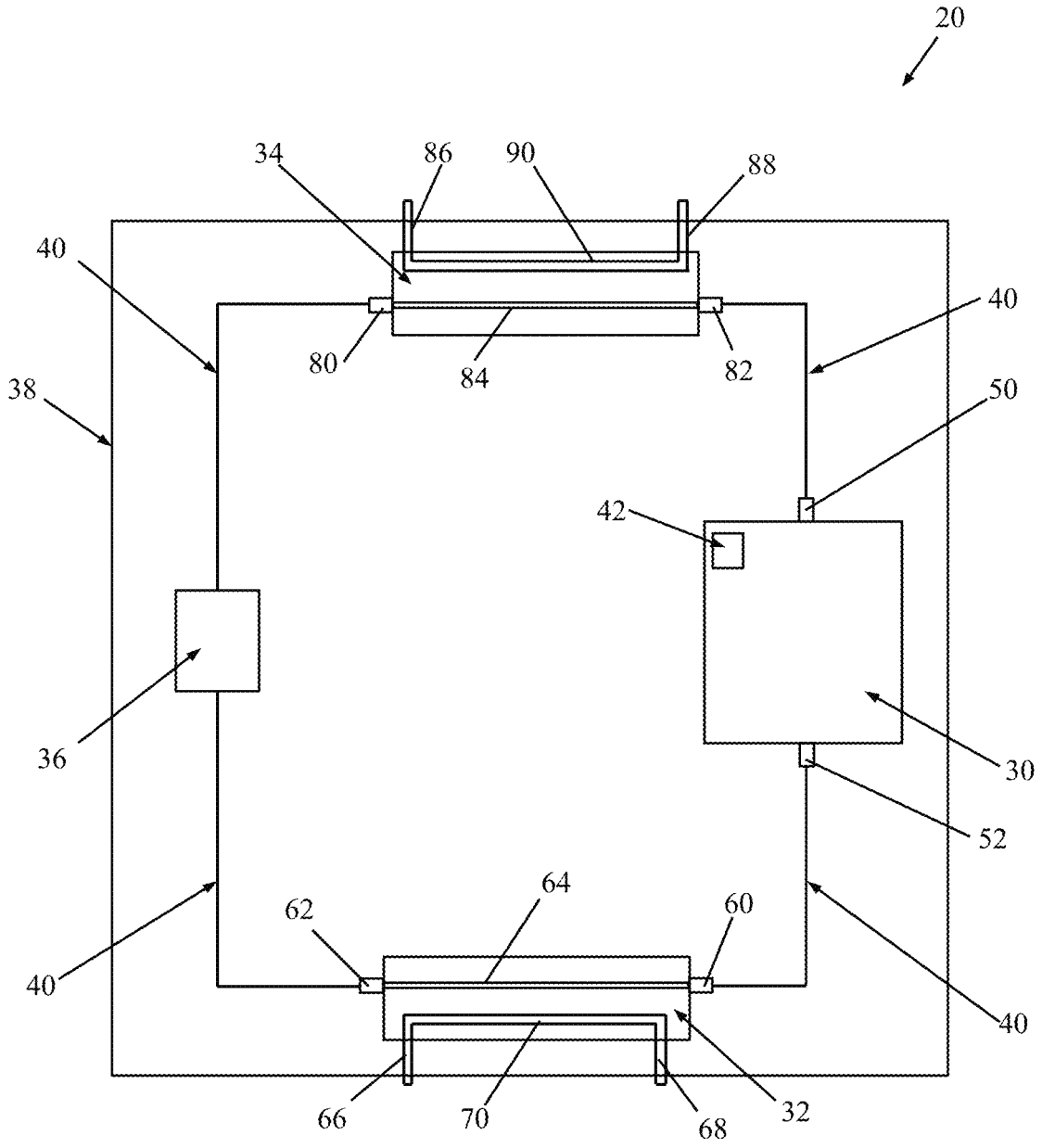
FIG. 1 is a schematic diagram of an industrial heat transfer unit in accordance with principles of the present disclosure.

Some aspects of the present disclosure entail improvements, changes, and/or alternatives to the modules, systems, and methods of U.S. Publication No. 2011/0239666 (Allen et al.), the entirety of which is hereby incorporated by reference herein. With this in mind, one embodiment of an industrial heat transfer unit 20 in accordance with principles of the present disclosure is shown in FIG. 1 and includes a compressor 30, a condenser heat exchanger 32, an evaporator heat exchanger 34, an expansion valve structure 36, and a housing 38. Details on the various components are provided below. In general terms, the compressor 30, the heat exchangers 32, 34, and the expansion valve structure 36 are maintained within the housing 38, with refrigerant lines 40 establishing a circulating flow path for refrigerant within the industrial heat transfer unit 20. As a point of reference, while an arrangement of the components 30-36 in FIG. 1 reflects a desired circulating flow pattern, a spatial relationship of the components 30-36 relative to one another within the housing 38 can vary from as described below. Heating and cooling are simultaneously provided by the industrial heat transfer unit 20 at the condenser heat exchanger 32 and the evaporator heat exchanger 34, respectively. In this regard, the industrial heat transfer unit 20 can optionally include one or more additional components, such a controller or similar computer-type device that controls operations of the industrial heat transfer unit 20 based, for example, upon information provided by one or more optional sensors. As a further point of reference, the industrial heat transfer units of the present disclosure can be characterized by the absence of a reversing valve; thus, some embodiments of the industrial heat transfer units of the present disclosure are not, and are significantly different from, a conventional heat pump system (e.g., a geo-thermal heat pump system).

The industrial heat transfer units 20 of the present disclosure are useful in a plethora of different applications or settings as described below. In more general terms, components of the industrial heat transfer units 20 of the present disclosure (e.g., the compressor 30 and heat exchangers 32, 34) can be formatted or customized to accommodate the operational demands associated with elevated cooling and heating demands of many industrial settings, such as a cooling capacity range on the order of 20-250 tons and a heating capacity range on the order of 288,000-3,600,000 BTU, utilizing a known refrigerant such as R410A, R134A, etc.

The compressor 30 can assume various forms known in the art appropriate for handling and compressing a selected refrigerant at the pressures, volumes and flow rates implicated by a particular end use application as mentioned above. In some embodiments, the compressor 30 is or includes a scroll compressor. Scroll compressors have surprisingly been found to meet the operational requirements of industrial end use applications. The compressor 30 includes a motor and a drive 42 controlling delivery of power to the motor. In some embodiments, the drive 42 is a variable frequency drive operating at the compressor 30 at a constant torque. It has surprisingly been found that implementation of a variable frequency drive in combination with a scroll compressor is highly efficient and capable of meeting the performance requirements of industrial end use applications. Other compressor and drive formats are also envisioned. Regardless, the compressor 30 forms or defines a refrigerant inlet 50 and a refrigerant outlet 52.

The condenser heat exchanger 32 can assume various forms known in the art appropriate for handling a selected refrigerant and facilitating transfer of heat to a process fluid (e.g., liquid or gas) at the pressures, volumes and flow rates implicated by a particular end use application as mentioned above. In this regard, the condenser heat exchanger 32 includes or provides a refrigerant inlet 60 and a refrigerant outlet 62 that are interconnected by a refrigerant line 64. In some embodiments, the refrigerant line 64 is a high pressure stainless steel tube or pipe. Process fluid is directed through the condenser heat exchanger 32 via a process fluid inlet 66 and a process fluid outlet 68. Depending upon a desired format, a process fluid line 70 can be provided with the condenser heat exchanger 32, interconnecting the process fluid inlet and outlets 66, 68 (e.g., where industrial heat transfer unit 20 is formatted to apply heat to a liquid process fluid at the condenser heat exchanger 32, the process fluid line 70 may be desired); where provided, in some embodiments the process fluid line 70 can be a high pressure stainless steel tube or pipe. In some embodiments, the condenser heat exchanger 32 is entirely formed of stainless steel. As a point of reference, heat pump manufacturers conventionally employ "brazed plate" type heat exchangers that utilize copper, brass or bronze materials that are not chemically compatible with some industrial applications of the present disclosure. It has surprisingly been found that forming the condenser heat exchanger 32 from stainless steel greatly enhances the ability of the industrial heat transfer unit 20 to continuously meet the performance requirements of industrial end use applications.

The evaporator heat exchanger 34 can assume various forms known in the art appropriate for handling a selected refrigerant and facilitating transfer of heat from a process fluid (e.g., liquid or gas) at the pressures, volumes and flow rates implicated by a particular end use application as mentioned above. In this regard, the evaporator heat exchanger 34 includes or provides a refrigerant inlet 80 and a refrigerant outlet 82 that are interconnected by a refrigerant line 84. In some embodiments, the refrigerant line 84 is a high pressure stainless steel tube or pipe. Process fluid is directed through the evaporator heat exchanger 34 via a process fluid inlet 86 and a process fluid outlet 88. Depending upon a desired format, a process fluid line 90 can be provided with the evaporator heat exchanger 34, interconnecting the process fluid inlet and outlets 86, 88 (e.g., where industrial heat transfer unit 20 is formatted to remove heat from a liquid process fluid at the evaporator heat exchanger 34, the process fluid line 90 may be desired); where provided, in some embodiments the process fluid line 90 can be a high pressure stainless steel tube or pipe. In some embodiments, the evaporator heat exchanger 34 is entirely formed of stainless steel. As a point of reference, heat pump manufacturers conventionally employ "brazed plate" type heat exchangers that utilize copper, brass or bronze materials that are not chemically compatible with some industrial applications of the present disclosure. It has surprisingly been found that forming the evaporator heat exchanger 34 of stainless steel greatly enhances the ability of the industrial heat transfer unit 20 to continuously meet the performance requirements of industrial end use applications.

From the explanations above, in some embodiments, the process fluid inlet 66, the process fluid outlet 68, and the process fluid line 70 of the condenser heat exchanger 32, and the process fluid inlet 86, the process fluid outlet 88, and the process fluid line 90 of the evaporator heat exchanger 34 are formed as high pressure stainless steel components ("industrial compatible" in terms of pressure rating, etc.). With this construction, the industrial heat transfer unit 20 can process aggressive chemicals, acids, etc. (as compared to conventional heat pump constructions that are limited to processing water or water-based derivatives).

The expansion valve structure 36 can assume various forms known in the art appropriate for handling a selected refrigerant and facilitating a pressure drop of the refrigerant delivered from the condenser heat exchanger 32 to the evaporator heat exchanger 34 at the pressures, volumes and flow rates implicated by a particular end use application as mentioned above. In general terms, the expansion valve structure 36 is or includes a thermal expansion valve or metering device.

Figure 2:
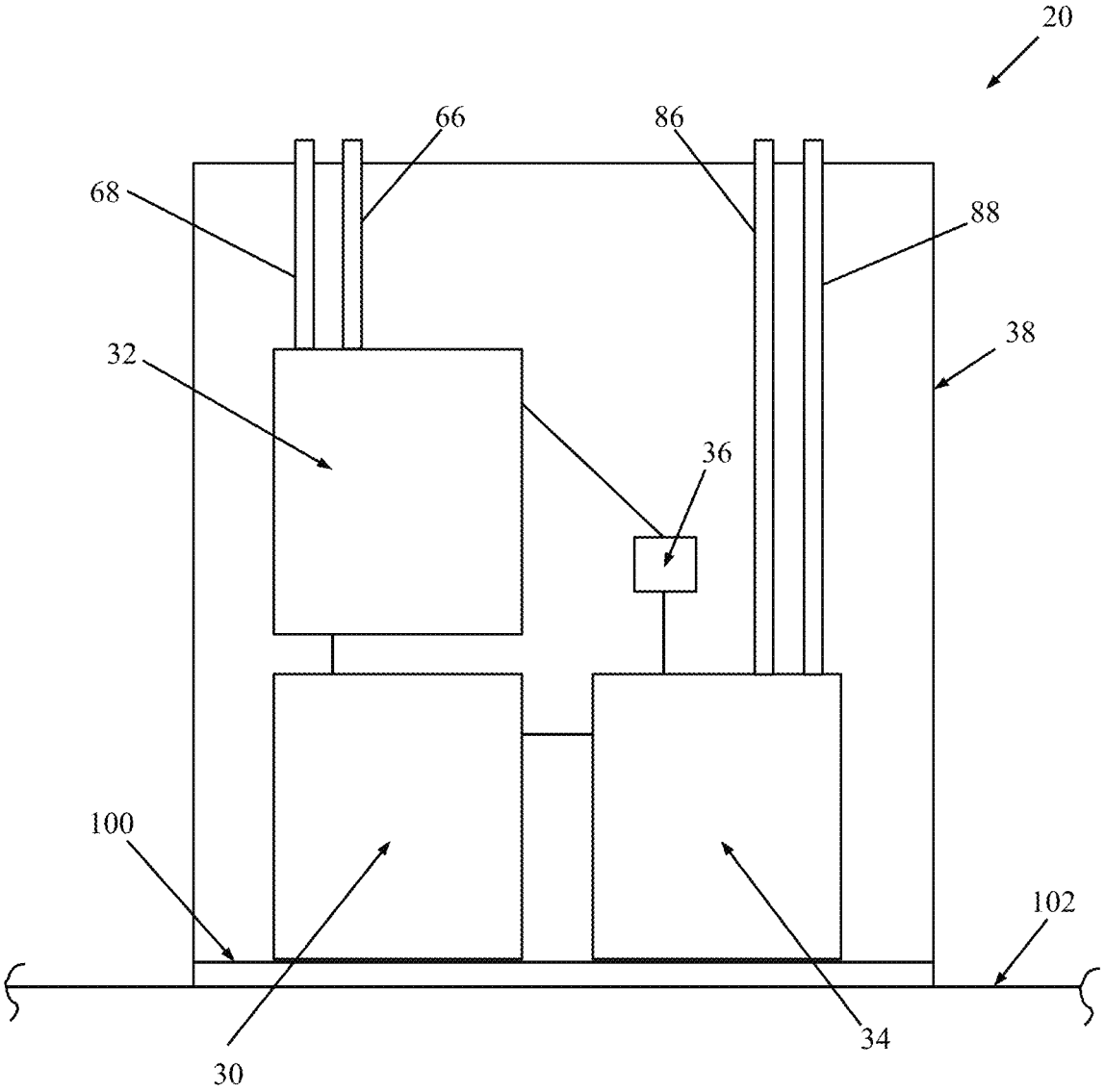
FIG. 2 is a simplified side view, with portions shown in block from, of the industrial heat transfer unit of FIG. 1.

The housing 38 can assume various forms and include various features configured to maintain the components 30-36 in a desired spatial arrangement. As a point of reference, the refrigerant recirculating flow pattern is dictated by the compressor 30, with the compressor 30 operating to receive refrigerant from the evaporator heat exchanger 34 and deliver refrigerant to the condenser heat exchanger 32. The refrigerant thus circulates through the industrial heat transfer unit 20, getting warmer as it passes through the compressor 30 toward the condenser heat exchanger 32, shedding heat in the condenser heat exchanger 32, getting cooler as it passes through the expansion valve structure 36 toward the evaporator heat exchanger 34, taking on heat in the evaporator heat exchanger 34, and cycling back through the compressor 30. With this in mind, FIG. 2 illustrates, in simplified form, an arrangement of the components 30-36 within the housing 38. The housing 38 generally encloses the components 30-36, and includes or provides a platform 100 that serves to support the industrial heat transfer unit 20 against a floor or other flat surface 102 of the installation site. FIG. 2 thus represents the intended, upright orientation of the industrial heat transfer unit 20. Relative to this upright orientation, the condenser heat exchanger 32 is maintained within the housing 38 vertically above the compressor 30 in some embodiments and in direct contrast to conventional heat pump systems. The condenser heat exchanger 32 can be aligned with the compressor 30 in the vertical direction. In related embodiments, the evaporator heat exchanger 34 can be horizontally aligned with the compressor 30 (e.g., the evaporator heat exchanger 34 is not substantively vertically above or below the compressor 30). It has surprisingly been found that the spatial arrangement of the condenser heat exchanger 32 and the evaporator heat exchanger 34 relative to the compressor 30 as shown in FIG. 2 establishes, via gravity, liquid columns conducive to highly efficient performance of the industrial heat transfer unit 20 in meeting the performance requirements of industrial end use applications.

Figure 3:
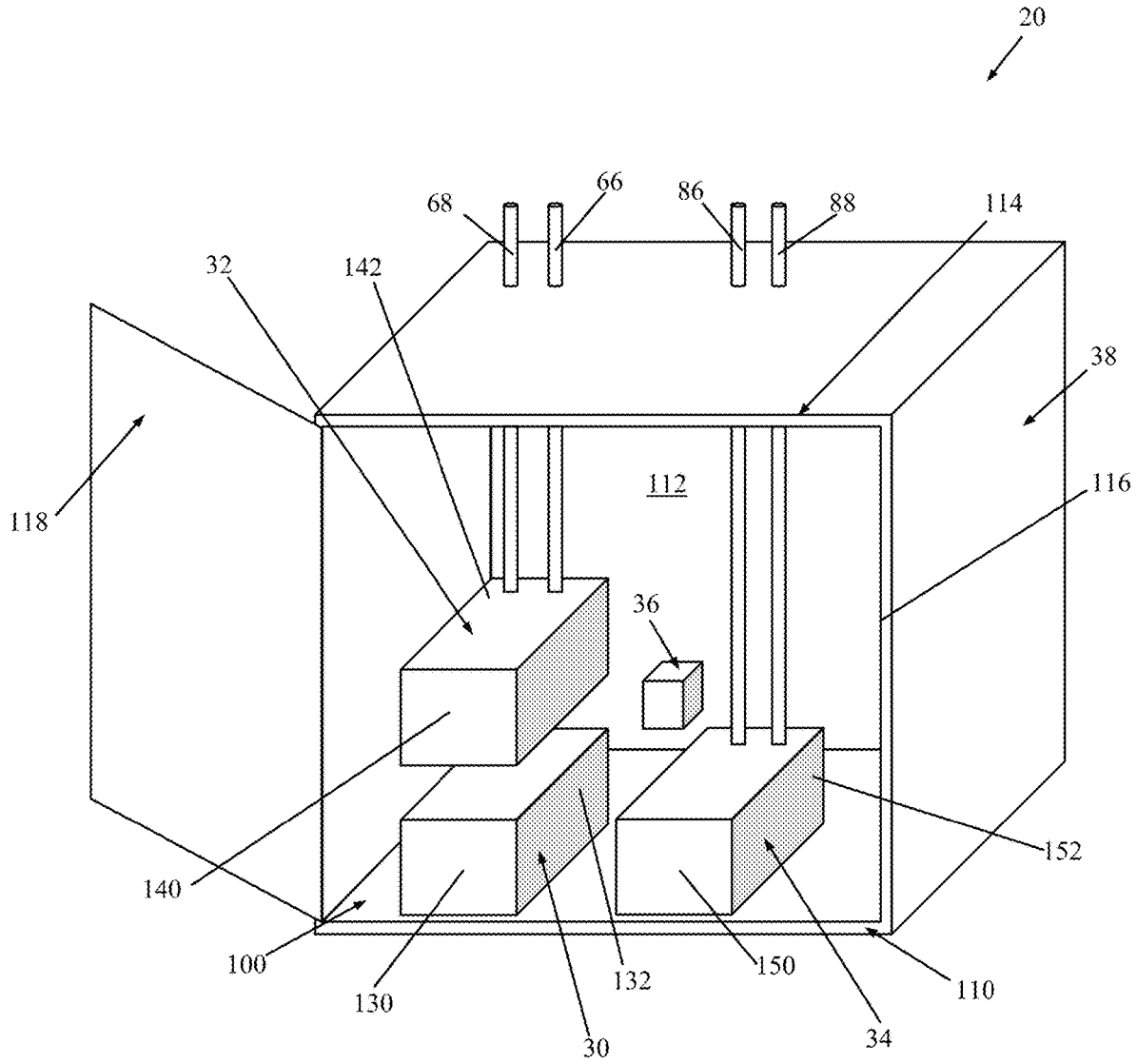
FIG. 3 is a simplified perspective view, with portions shown in block form, of the industrial heat transfer unit of FIG. 1.

An additional spatial arrangement feature utilized with some embodiments of the present disclosure is reflected by the simplified perspective view of FIG. 3. As described above, the components 30-36 are maintained within the housing 38. In addition to the platform 100, the housing 38 includes or defines a first side 110 opposite second side 112 (referenced generally). A frame 114 (referenced generally) of the housing 38 forms a window 116 at the first side 110. At least one door 118 is connected to the frame 114 (e.g., hinged or sliding connection) at the first side 110, and is operable to selectively open and close the window 116 (e.g., in the arrangement of FIG. 3, the door 118 is in the opened position). With this in mind, one or more (including all) of the compressor 30, the condenser heat exchanger 32, and the evaporator heat exchanger 34 are arranged within the housing 38 such that a corresponding service side thereof faces the first side 110 and is thus readily accessible via the window 116 when the door 118 is opened. As a point of reference, the compressor 30, the condenser heat exchanger 32, and the evaporator heat exchanger 34 are conventionally understood to have a service region (or service side) and a process region (or process side). The service region is generally understood to be in reference to a portion or segment of the device at which maintenance, repairs, etc., are commonly performed. The process region, on the other hand, is that portion or segment of the device at which fluid transfer or work is performed (e.g., refrigerant acted upon, process fluid handled, etc.). Thus, for example, the compressor 30 can be viewed as having or defining a service region 130 opposite a process region 132. Though hidden in the view of FIG. 3, the process region 132 of the compressor 30 can include the refrigerant inlet and outlet 50, 52 (FIG. 1), whereas the service region 130 includes the motor and the drive 42 (FIG. 1). Service and process regions 140, 142 of the condenser heat exchanger 32 are also generally identified, with the process region 142 generally including the refrigerant inlet and outlet 60, 62 and the refrigerant line 64 (FIG. 1), along with the process fluid inlet 66 and the process fluid outlet 68. Similarly, service and process regions 150, 152 of the evaporator heat exchanger 34 are generally identified, with the process region 152 generally including the refrigerant inlet and outlet 82, 84 and the refrigerant line 84 (FIG. 1), along with the process fluid inlet 86 and the process fluid outlet 88. It has surprisingly been found that by arranging one or more or all of the compressor 30, the condenser heat exchanger 32, and the evaporator heat exchanger 34 with the corresponding service region 130, 140, 150 adjacent or facing the first side 110 of the housing 38, and in particular the window 116, the industrial heat transfer unit 20 is capable of meeting the performance requirements of industrial end use applications while providing straightforward user access for repair or maintenance.

Figure 4A:
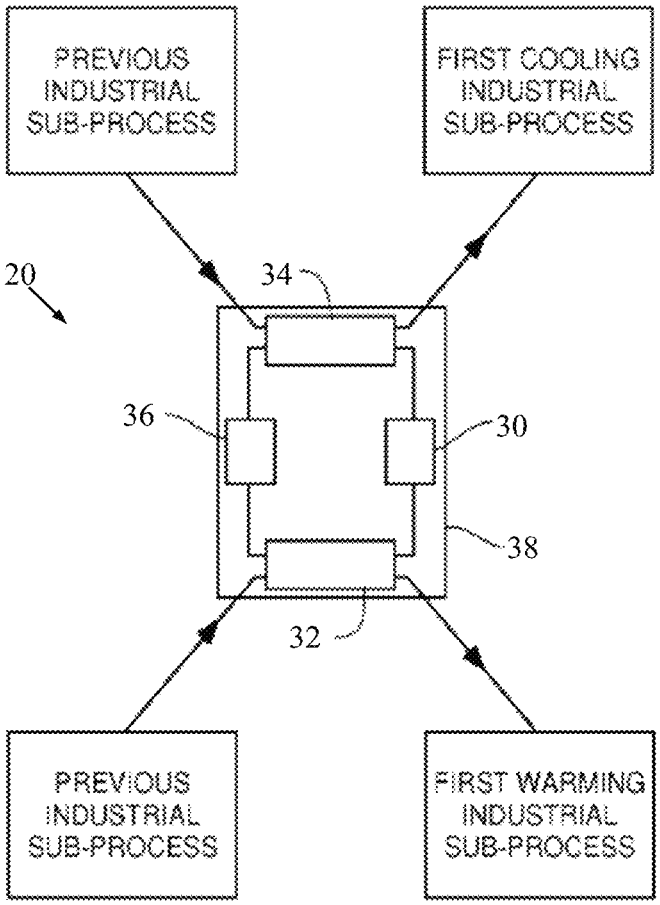
FIGS. 4A and 4B are schematic diagrams of the industrial heat transfer unit of FIG. 1 installed and operating to transfer heat energy from a process fluid to be cooled to a process fluid to be warmed.
Figure 4B:
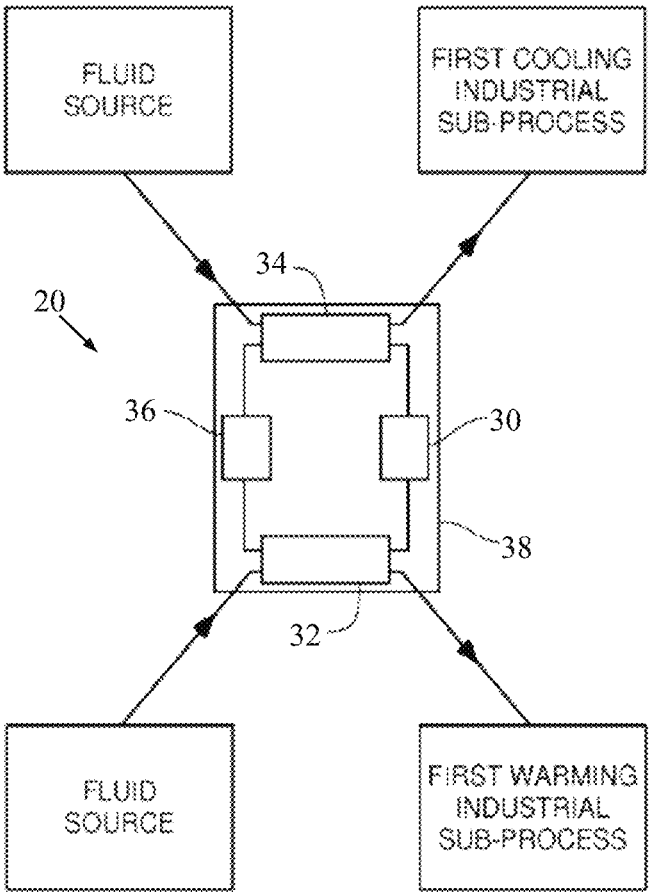

The industrial heat transfer units of the present disclosure are useful in multiple different industrial applications where simultaneous heating and cooling are desired or beneficial. By way of further background, FIGS. 4A and 4B reflect possible industrial applications of the industrial heat transfer unit 20. The refrigerant typically sheds heat to one fluid (e.g., liquid, vapor, gas, etc.) in the condenser heat exchanger 32 and takes on heat from a different fluid in the evaporator heat exchanger 34. As shown in FIGS. 4A and 4B, the refrigerant circulating through the industrial heat transfer unit 20 can take on heat from a fluid flowing toward a cooling industrial sub-process in the evaporator heat exchanger 34. One non-limiting example of cooling industrial sub-process is condensing unwanted components out of a vapor/gas streams (e.g., scrubbing pollutants out of an industrial waste stream). Another common example of a cooling industrial sub-process is removing heat from industrial equipment (e.g., a fermentation vessel in an ethanol production process). Other examples of cooling industrial sub-processes come from the food processing industry, such as cooling cans in a large-scale vegetable canning plant to ambient temperature after the food inside has been cooked and/or pasteurized or freezing prepared food after it has been cooked and packaged. Embodiments of the present disclosure are useful with and enhance many kinds of cooking industrial sub-processes. In some embodiments, the cooling fluid enters the evaporator heat exchanger 34 from a previous industrial sub-process. In some systems, the cooling fluid enters the evaporator heat exchanger 34 from a fluid source (e.g., a well).

FIGS. 4A and 4B also shows that the refrigerant circulating through the industrial heat transfer unit 20 can she heat to a fluid flowing toward a warming industrial sub-process in the condenser heat exchanger 32, akin to a heat pump (it being noted that with some embodiments of the industrial heat transfer units of the present disclosure, a reversing or switching valve is not provided such that the industrial heat transfer unit is distinct from a conventional heat pump system). In this way, heat from the process fluid being cooled can be transferred to the process fluid being heated through the refrigerant via the evaporator heat exchanger 34 and the condenser heat exchanger 32. One non-limiting example of a warming industrial sub-process is drying elements being processed (e.g., distilled grain in an ethanol production process). Another example is heating various processing equipment (e.g., equipment for warming cold corn flour during winter months leading to the slurry system where hot water is added). Another common example is pre-heating fluids before they enter processing vessels, such as warming water before it enters an ethanol cook system, pre-warming cold influent well water prior to process systems requiring heat for process effect, warming well water to propagate yeast, and so on. In some systems, the process fluid to be warmed enters the condenser heat exchanger 32 from a previous industrial sub-process. In some systems, the fluid to be warmed enters the condenser heat exchanger 32 from a fluid source (e.g., ambient air). The fluid to be warmed can enter the condenser heat exchanger 32 from a fluid source and the fluid to be cooled can enter the evaporator heat exchanger 34 from a previous industrial sub-process, or the fluid to be warmed can enter the condenser heat exchanger 32 from a previous industrial sub-process and the fluid to be cooled can enter the evaporator heat exchanger 34 from a fluid source—many combinations are possible.

In addition to the absence of reversing or switching valve, industrial heat transfer units of the present disclosure can have important differences from heat pumps used in HVAC applications. One difference relates to how the heat transfer units are controlled. In HVAC applications, precise input and output parameters (e.g., temperature, flow rate, etc.) are generally less important than in industrial applications. Heat transfer modules for HVAC applications specifically endeavor to provide a heating or cooling effect for ambient conditioning. Minor variations in HVAC fluid parameters tend to have little effect on the overall comfort of the conditioned space. Moreover, because noticeable changes in the overall comfort of the conditioned space tend to occur slowly, heat transfer module operation adjustments can usually be made quickly enough to prevent any discomfort in the conditioned space. In contrast, if the industrial heat transfer units of the present disclosure do not precisely control warming/cooling fluid parameters in an industrial installation, significant downstream consequences can result. Additionally, in HVAC applications, if the heat transfer module is cooling the conditioned space, what happens to the heat drawn out of the space is typically of little concern. Likewise, if the HVAC heat transfer module is heating the conditioned space, the effect on the environment from which the heat is drawn is typically of little concern. In contrast, when industrial heat transfer units of the present disclosure are used in industrial applications, they must usually be controlled to account for both the cooling fluid parameters and the warming fluid parameters because the fluids will be used in separate industrial sub-processes. For these and other reasons, precise control of the fluid parameters is of greater importance with the industrial heat transfer units of the present disclosure as compared to HVAC heat transfer modules. Another difference between heat transfer modules used in HVAC applications and the industrial heat transfer units of the present disclosure is that the metallurgy of one or more of the heat exchangers 32, 34 must often be modified to accommodate the fluids to be warmed or to be cooled as many such fluids contain chemicals that may erode conventional heat exchangers. Other optional benefits or differences presented by the industrial heat transfer units of the present disclosure include digital control (instead of conventional analog control), industrial-grade end use applications (instead of conventional commercial-grade end use applications), and/or higher performing control action (i.e., faster and more precise control as compared to conventional heat exchange designs).

In some embodiments, two or more of the industrial heat transfer units of the present disclosure can be utilized or installed for a particular industrial end use application. Non-limiting examples of such configurations and corresponding methods are provided in U.S. Publication No. 2011/0239666 (Allen et al.), the teachings of which are incorporated herein by reference.

In some embodiments, the industrial heat transfer units of the present disclosure can be utilized or operated without an energy field or centralized energy storage. In other embodiments, the industrial heat transfer unit can be utilized with a cooling tower as described, for example, in U.S. Publication No. 2011/0239666 (Allen et al.), the teachings of which are incorporated herein by reference.

The industrial heat transfer units of the present disclosure can include one or more controllers programmed (e.g., hardware, software, etc.) to operate the compressor 30 or other unit components in a pre-determined manner, for example based upon information provided by one or more sensors. Non-limiting examples of controllers and control methodologies are provided in U.S. Publication No. 2011/0239666 (Allen et al.), the teachings of which are incorporated herein by reference.

The industrial heat transfer units and corresponding methods of operation of the present disclosure are useful in a multitude of industrial setting. For example, the industrial heat transfer units can be implemented as part of an ethanol (or other biofuel) production facility or process, data centers, food and beverage processing and packaging, multi-room facilities, etc.

Although the present disclosure has been described with reference to preferred embodiments, workers skilled in the art will recognize that changes can be made in form and detail without departing from the spirit and scope of the present disclosure.

What is claimed is:

1. An industrial heat transfer unit comprising:

a compressor defining an inlet and an outlet;

a condenser heat exchanger defining an inlet and an outlet, wherein the outlet of the compressor is fluidly connected to the inlet of the condenser heat exchanger;

an expansion valve structure defining an inlet and an outlet, wherein the outlet of the condenser heat exchanger is fluidly connected to the inlet of the expansion valve structure;

an evaporator heat exchanger defining an inlet and an outlet, wherein the outlet of the expansion valve structure is fluidly connected to the inlet of the evaporator heat exchanger, and further wherein the outlet of the evaporator heat exchanger is fluidly connected to the inlet of the compressor; and a housing within which the compressor, the condenser heat exchanger, the evaporator heat exchanger and the expansion valve structure are maintained;

wherein relative to an upright orientation of the industrial heat transfer unit, the condenser heat exchanger, including the inlet of the condenser heat exchanger and the outlet of the condenser heat exchanger, is retained vertically above, and vertically aligned with, the compressor, and the evaporator heat exchanger and the compressor are horizontally aligned.

2. The industrial heat transfer unit of claim 1, wherein the housing defines a first side opposite a second side, and further wherein the compressor and the condenser heat exchanger each define a service region opposite a process region, and even further wherein the compressor and the condenser are arranged within the housing such that the corresponding service region faces the first side.

3. The industrial heat transfer unit of claim 2, wherein the evaporator heat exchanger defines a service region opposite a process region, and further wherein the evaporator heat exchanger is arranged within the housing such that the service region of the evaporator heat exchanger faces the first side.

4. The industrial heat transfer unit of claim 2, wherein the housing includes a frame and a door, wherein the frame defines a window at the first side and the door is mounted to the frame for selectively opening and closing the window.

5. The industrial heat transfer unit of claim 2, wherein the process region of the compressor includes the inlet and outlet of the compressor.

6. The industrial heat transfer unit of claim 5, wherein the process region of the condenser heat exchanger includes the inlet and outlet of the condenser heat exchanger.

7. The industrial heat transfer unit of claim 6, wherein:

the condenser heat exchanger further includes a refrigerant line fluidly connecting the inlet and outlet of the condenser heat exchanger and a process line fluidly connecting and extending between a process fluid inlet and a process fluid outlet, and further wherein the process line, process fluid inlet and process fluid outlet are located along the process region of the condenser heat exchanger;

the evaporator heat exchanger further includes a refrigerant line fluidly connecting the inlet and outlet of the evaporator heat exchanger and a process line fluidly connecting and extending between a process fluid inlet and a process fluid outlet, and further wherein the refrigerant line, inlet, outlet, process line, process fluid inlet and process fluid outlet of the evaporator heat exchanger are located along the process region of the evaporator heat exchanger;

the compressor further includes a motor and drive located along the service region of the compressor.

8. The industrial heat transfer unit of claim 1, wherein the condenser heat exchanger further includes a refrigerant line fluidly connecting the inlet and outlet of the condenser heat exchanger and a process line fluidly connecting and extending between a process fluid inlet and a process fluid outlet, and further wherein the process line is formed of stainless steel.

9. The industrial heat transfer unit of claim 8, wherein the evaporator heat exchanger further includes a refrigerant line fluidly connecting the inlet and outlet of the evaporator heat exchanger and a process line fluidly connecting and extending between a process fluid inlet and a process fluid outlet, and further wherein the process line of the evaporator heat exchanger is formed of stainless steel.

10. The industrial heat transfer unit of claim 1, wherein the compressor is a scroll compressor.

11. The industrial heat transfer unit of claim 1, wherein the compressor includes a motor and a variable frequency drive controlling delivery of power to the motor.

12. The industrial heat transfer unit of claim 1, wherein the industrial heat transfer unit is characterized by the absence of a reversing valve.

13. The industrial heat transfer unit of claim 1, wherein the condenser heat exchanger further defines a process fluid inlet and a process fluid outlet, and further wherein relative to the upright orientation of the industrial heat transfer unit, the process fluid inlet and the process fluid outlet are retained vertically above the compressor.

* * * * *